United States Patent [19]

Bacchiere et al.

[11] Patent Number: 4,523,250

[45] **Date of Patent: * Jun. 11, 1985**

[54] MAGNETIC CHUCK CONTROL SYSTEM

[75] Inventors: Daniel P. Bacchiere, 7067 Birchwood Ave., Niles, Ill. 60648; Stanley F. Polinski, Chicago, Ill.

[73] Assignee: Daniel P. Bacchiere, Niles, Ill.

[ * ] Notice: The portion of the term of this patent subsequent to Dec. 15, 1998 has been disclaimed.

[21] Appl. No.: 479,867

[22] PCT Filed: Dec. 8, 1980

[86] PCT No.: PCT/US80/01624

§ 371 Date: Feb. 9, 1982

§ 102(e) Date: Feb. 9, 1982

[87] PCT Pub. No.: WO81/01769

PCT Pub. Date: Jun. 25, 1981

Related U.S. Application Data

[63] Continuation-in-part of Ser. No. 101,508, Dec. 7, 1979, Pat. No. 4,306,269.

[51] Int. Cl.[3] ..... H01F 13/00

[52] U.S. Cl. ..... 361/145; 335/289; 361/149

[58] Field of Search ..... 361/143, 145, 149; 335/289, 290

[56] References Cited

U.S. PATENT DOCUMENTS 4,370,693 1/1983 McDonald ..... 361/145

4,402,032 8/1983 Wilterdink ..... 361/145

*Primary Examiner*—Gene Z. Rubinson

*Assistant Examiner*—L. C. Schroeder

*Attorney, Agent, or Firm*—Fitch, Even, Tabin & Flannery

[57] ABSTRACT

Prior art magnetic chuck control systems do not utilize state of the art components and do not sufficiently isolate the power output from control circuits. The instant invention discloses a magnetic chuck control system employing solid state circuitry including a power output circuit (24) adapted to apply a DC voltage to an object such as a magnetic chuck (12) or the like so as to magnetize the same. The power output circuit employs a triac reversing circuit and is interfaced with a digital control circuit (26) and a digital-to-analog converter circuit (30) so as to apply alternating polarity voltage signals of successively reduced magnitude to the chuck during a demagnetizing operation. All high voltage is confined to the power output circuit so as to provide significant safety protection to the operator. Various control functions such as full power, variable power, residual power and release have digital interlocking so that an operator must effect full power or variable power after a residual power function.

7 Claims, 6 Drawing Figures

MAGNETIC CHUCK CONTROL SYSTEM

This application is a continuation-in-part of Ser. No. 101,508, now U.S. Pat. No. 4,306,269, filed Dec. 7, 1979.

The present invention relates generally to magnetic control systems, and more particularly, to a magnetic control system employing novel solid state circuit means for effecting demagnetizing of an object such as a magnetic chuck and associated ferromagnetic work piece or the like.

It is known that in employing a magnetic chuck to hold a ferromagnetic work piece in a machine tool or the like, the chuck and the work piece, upon deenergizing, retain significant residual magnetism which inhibits release of the work piece from the chuck. It is conventional in such cases to demagnetize the magnetic chuck and associated work piece so as to enable release of the work piece. Such demagnetizing is generally accomplished by passing a current through the chuck, and thereby the associated work piece, in alternating opposite directions by reversing the polarity in a series of steps while lowering the voltage potential in each successive step until the voltage potential reaches substantially zero at which time the chuck and work piece are sufficiently demagnetized to allow the work piece to be readily separated from the magnetic chuck.

A general object of the present invention is to provide a novel magnetic control system which finds particular application in controlling magnetic chucks and the like, and which is adapted to effect demagnetizing of the chuck and associated work piece so as to enable an operator to readily remove the work piece from the chuck.

A more particular object of the present invention is to provide a totally solid state magnetic chuck control system employing a power output circuit interfaced with a digital control circuit and digital-to-analog converter circuit so that the power output circuit is adapted to apply output voltage signals to the chuck of successively decreasing magnitude and alternating polarity during a demagnetizing operation.

Still another object of the present invention is to provide a magnetic chuck control system having a power output circuit connected to a DC power supply and interfaced with a digital control circuit and a digital-to-analog converter circuit operative on the power output circuit to establish output voltage signals to the chuck of alternating polarity and successively decreasing magnitude during a demagnitizing operation, the digital control and digital-to-analog circuit being of low voltage operation and isolated from the high voltage power output circuit so as to protect the operator should a fault current occur in the power output circuit.

A feature of the magnetic chuck control system in accordance with the present invention lies in the provision of a visual display adapted to digitally indicate the various cycles of voltage reversal during a demagnetizing operation and thereby inform the operator when demagnetizing has been completed.

Another feature of the magnetic chuck control system in accordance with the present invention lies in the employment of a digital-to-analog converter circuit for controlling the magnitude of the output signals from the power output circuit to the magnetic chuck, the digital-to-analog converter circuit including a variable power adjustment enabling selection of the magnetic chuck holding power to a magnitude less than 100% of full power.

Another feature of the magnetic chuck control system in accordance with the present invention lies in the use of triacs in a reversing circuit portion of the power output circuit, the triacs being connected in a bridge type circuit and having their respective gates interfaced with the digital control circuit through optical couplings so as to isolate the digital control circuit from the substantially higher current controlled by the triacs.

Still another feature of the magnetic chuck control system in accordance with the invention lies in the provision of various control functions such as full power, variable power, residual power and release, and wherein the various functions are digitally interlocked so that an operator must effect full or variable power after a residual power function to insure complete reduction of any residual magnetism to zero.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 2:
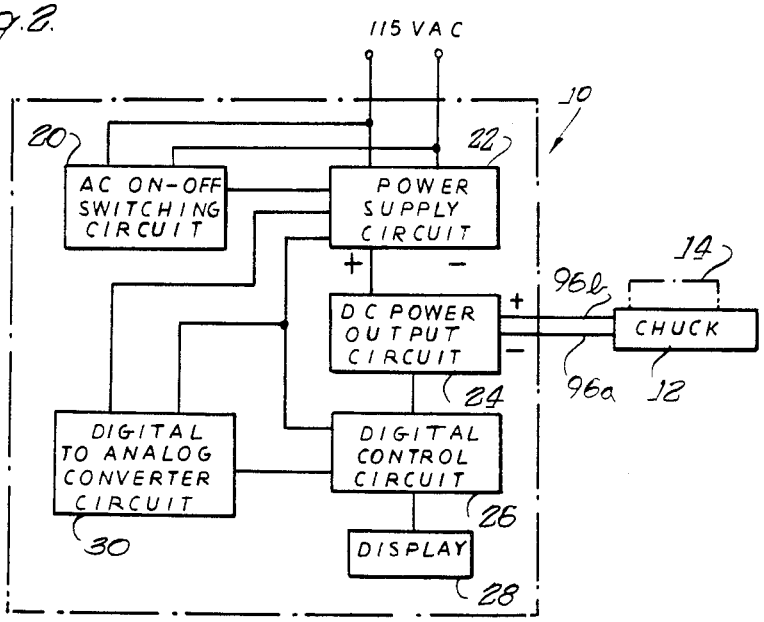
FIG. 2 is a schematic block diagram of the various circuits comprising one embodiment of the magnetic chuck control system of the invention.
Figure 3:
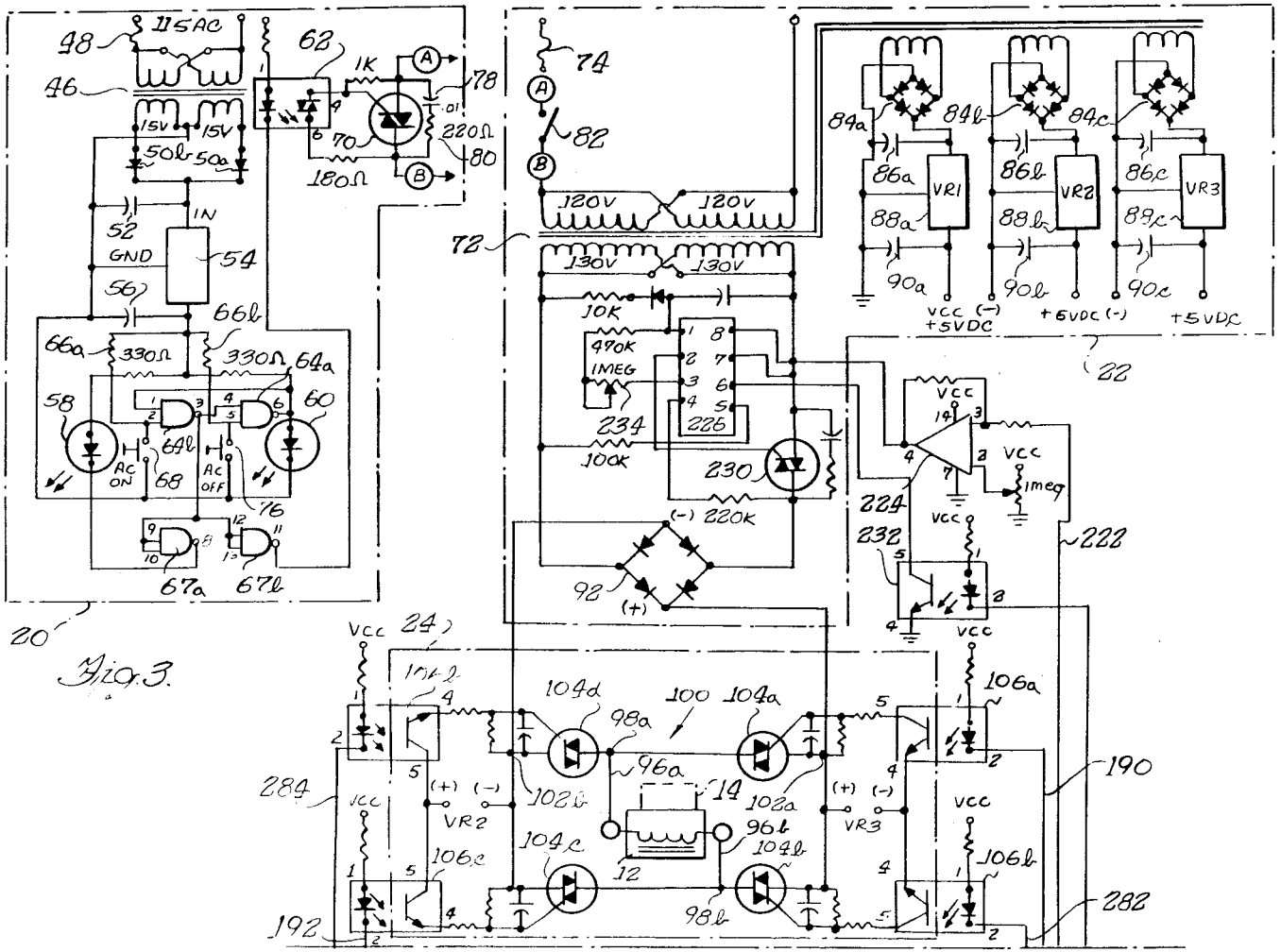
FIG. 3 is a circuit diagram of the power supply circuit, the optional AC on-off switching circuit and the DC power output circuit of the magnetic chuck control system illustrated schematically in FIG. 2.

The various features of the magnetic control system in accordance with the present invention are described herein, by way of illustration, in conjunction with a control system, indicated generally by reference numeral 10 in FIG. 2, for controlling a magnetic chuck, indicated schematically at 12 in FIGS. 2 and 3. The magnetic chuck 12, which may also be termed an electromagnet, is adapted to have a ferromagnetic work piece or other object, such as indicated in phantom at 14, mounted thereon and magnetically maintained in fixed relation on the chuck during the performance of various operations on the work piece. For example, the magnetic chuck 12 may be employed in a machine tool as a work holder during which various operations may be performed on the work piece. The magnetic chuck 12 may, in turn, be mounted on a reciprocating table or the like, so that the associated work piece 14 is moved in predetermined relation to a tool, or alternatively, the magnetic chuck and associated work piece may be maintained in stationary relation and the tool moved relative to the chuck. Magnetic chucks of the type with which the control system of the present invention may be employed are well known and do not, per se, form a part of the present invention.

Very generally, the magnetic control system 10 includes an AC on-off switchinq circuit 20 which, in the described embodiment, is optional but is shown connected to a suitable AC power supply, such as a 115 VAC supply, and is also connected to a power supply circuit 22 in a manner to enable energizing of the power supply circuit by the 115 VAC power supply. The power supply circuit 22 includes a bridge rectifier to provide a 115 VDC output which is applied to a DC power output circuit 24 the output of which is connected to the magnetic chuck 12 to facilitate magnetic holding of a ferromagnetic work piece or object 14 on the magnetic chuck. The power output circuit 24 is interfaced with a digital control circuit 26 and a digital-to-analog converter circuit 30 which cooperate to enable magnetizing and demagnetizing of the chuck and associated work piece. As will be described more fully hereinbelow, the converter circuit 30 includes a variable power adjustment which enables selection of the magnetic chuck holding power to a magnitude less than 100% of full power.

The power supply circuit 22 is also adapted to provide regulated low voltage DC output signals, such as ±5 VDC, to the digital control circuit 26 which establishes digital output pulse signals of predetermined equal interval timed relation and which are counted and displayed on a visual display 28 adapted to provide a digital indication to the operator of the polarity reversal cycle and the polarity of the signal then being applied to the chuck during a demagnetizing operation.

The timed digital pulse signals from the digital control circuit 26 are also applied to the digital-to-analog converter circuit 30 which also receives a +5 VDC power supply from the power supply circuit 22. The digital-to-analog converter circuit 30 is adapted to supply an amplified analog output signal to the power supply circuit 22 and cooperates with the digital control circuit 26 to control the AC power applied to the bridge rectifier of the power supply circuit and thus the DC power applied to the magnetic chuck.

The DC power output circuit 24 includes a reversing circuit in the form of triacs connected in a bridge type network and having their gates triggered by the digital control circuit 26 so as to provide precise digital timing. The reversing circuit controls the direction of current flow through the magnetic chuck 12 and thus the polarity of the voltage output signals applied to the magnetic chuck 12 during a demagnetizing operation. The successive voltage signals applied to the chuck 12 during demagnetizing are of precise predetermined decreasing magnitude as established by the digital-to-analog converter circuit 30.

Figure 1:
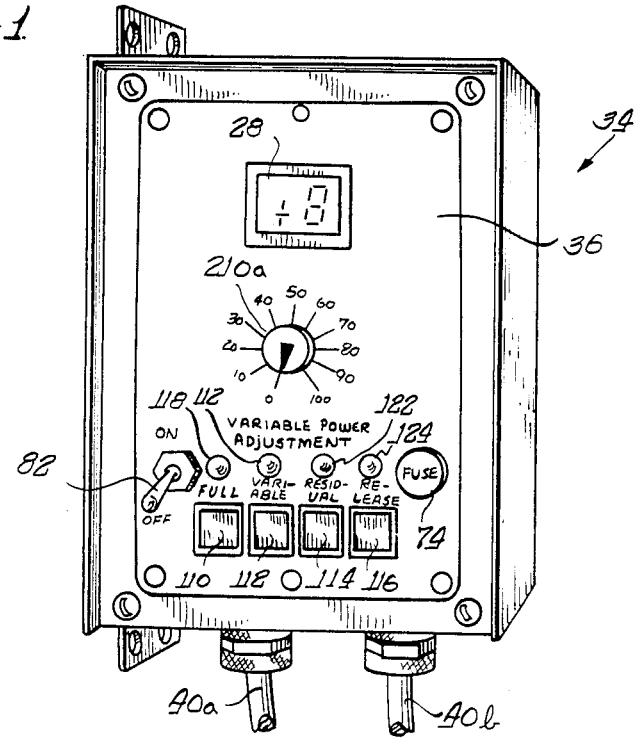
FIG. 1 is a perspective view of a control console containing the various circuits comprising the magnetic chuck control system in accordance with the present invention.

The various circuits 20, 22, 24, 26 and 30 of the magnetic chuck control system 10 are preferably contained within a suitable waterproof console or housing such as indicated generally at 34 in FIG. 1. In the illustrated embodiment, the console 34 comprises a generally rectangular housing which is substantially closed on all sides and has a front wall 36 forming a removable control panel on which are mounted the digital display 28 and various switches and associated function indicator lamps as will be described. Suitable tubular conduits 40*a* and 40*b* are connected to the housing 34 for a 3-wire AC power supply and for conductors connecting the DC power output circuit 24 to the magnetic chuck 12.

Figure 4:
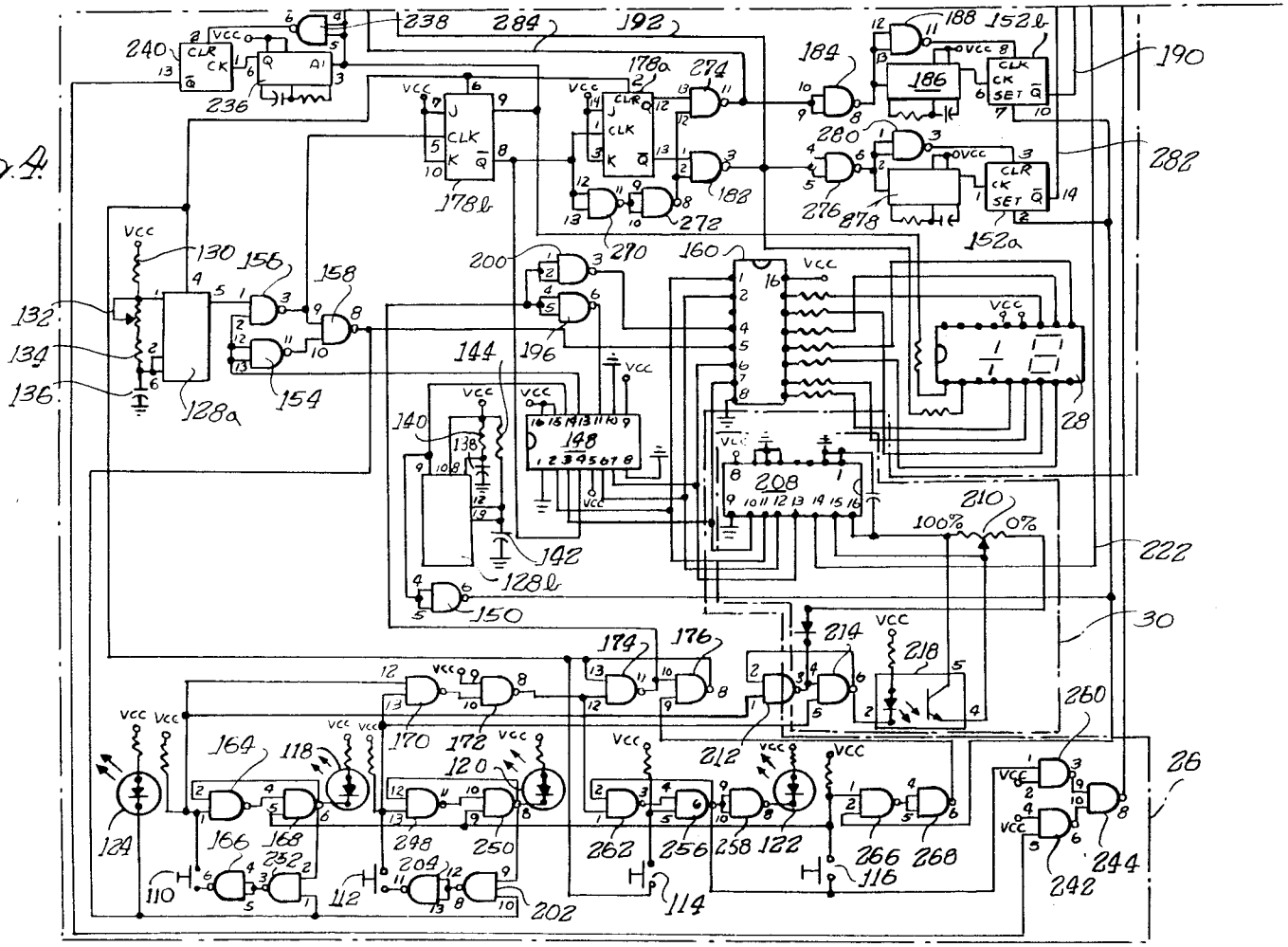
FIG. 4 is a circuit diagram of the digital control and digital-to-analog converter circuits of the magnetic chuck control system illustrated schematically in FIG. 2.

Referring now to FIGS. 3 and 4 for a more detailed description of the various circuits comprising the magnetic chuck control svstem 10 as illustrated schematically in FIG. 2, the AC on-off switching circuit 20 includes a dual voltage control transformer 46 having a fused primary connected to the 115 VAC power source through a suitable fuse 48. Transformer 46 has a low voltage secondary adapted to provide two 15 VAC outputs which are connected in circuit with suitable diodes 50*a* and 50*b*, an input filter capacitor 52, a voltage regulator 54 and an output filter capacitor 56 to provide a regulated 5 VDC for a light emitting diode (LED) 58, an LED 60, an optically isolated triac driver 62, alternatively termed an cptical coupler, and a pair of serially connected NAND gates 64*a* and 64*b*. The NAND gates 64*a* and 64*b* form a bistable switch having an output at pin 6 which can assume logic states "0" or "1". Logic "0" is ground and "1" is approximately 5 VDC. Pin 2 of NAND gate 64*b* is "1" through a current limiting resistor 66*a* to (+) 5 VDC, and pin 5 of NAND gate 64*a* is "1" through a current limiting resistor 66*b* to (+) 5 VDC. This insures pins 2 and 5 being held to a "1" state at the first moment of applying power to the circuit.

As aforementioned, the AC on-off switching circuit 20 is optional. It is contemplated that the switching circuit 20 be employed for large size magnetic chuck control systems, such as for greater than approximately 1000 watt control systems. With magnetic chuck control systems for smaller power requirements, such as below 1000 watts, the switching circuit 20 may optionally be eliminated and the AC power supply for the power supply circuit 22 obtained from the machine with which the system 10 is used or another suitable source.

If the on-off switching circuit 20 is employed, the LED 58, which may comprise an individual lamp of T-1 ¾ size adapted to give off a red light when energized, may be mounted on the panel 36 of the console 34. Similarly, LED 60, which may comprise a similar size lamp adapted to give off an orange light, may also be mounted on the control panel 36. When first applying power to transformer 46, pin 6 of NAND gate 64*a* is at a "1" state, which enables LED 60 to light. At this time, pin 3 of NAND gate 64*b* is at a "0" state making pins 9 and 10 of an inverter 67*a* "0" and making pin 8 "1". This keeps LED 58 OFF. At this time pins 12 & 13 of an inverter 67*b* are "0" and pin 11 is "1". This keeps optical coupler 62 off.

An AC normally open "on " switch 68, which preferably comprises a sealed membrane type switch such as commercially available from Sheldahl Corporation and which may be mounted on control panel 36, is connected between ground and the NAND gate 64*b* so that closing switch 68, termed the AC "on" switch when the switching circuit 20 is employed, establishes a "0" level at pin 6 of NAND gate 64*a*. This makes LED 60 go off and turns on LED 58. Closing switch 68 also enables the optical coupler 62 to turn on so as to energize a triac 70, which, assuming connection of the switch circuit 20 to the power supply circuit 22, enables the primary of a main power transformer 72 in the power supply circuit 22 to be energized by the 115 VAC power source through a fuse 74.

A switch 76, which also may be mounted on control panel 36 and may comprise a normally open preferably sealed membrane type switch similar to switch 68, is connected between ground and NAND gate 64*a* so that closing switch 76 establishes a "1" level at pin 6 of NAND gate 64*a*. This turns off the optical coupler 62 and LED 58 and turns on LED 60. Turning off optical coupler 62 deenergizes the triac 70 and removes the AC voltage from the primary of the transformer 72. A capacitor 78 and a resistor 80 are connected across the triac 70 so as to form a phase shift network to enable triac 70 to turn on and off.

An AC on-off switch 82 is connected in circuit with the primary of transformer 72 for use when the power supply circuit 22 is connected to a 115 VAC supply derived from the machine with which the control system 10 is employed or another suitable source, and the AC switching circuit 20 is not utilized. The switch 82 is preferably mounted on the control panel 36 as illustrated in FIG. 1.

With the primary of power transformer 72 turned on, three separate regulated +5 VDC power supplies are derived from three separate low voltage secondaries of transformer 72, bridge rectifiers 84*a*, 84*b* and 84*c*, input filter capacitors 86*a*, *b* and *c*, voltage regulators 88*a*, *b* and *c*, and output filter capacitors 90*a*, *b* & *c*. One regulated +5 VDC, designated "VCC", provides a low voltage power supply to the digital control circuit 26 and the digital-to-analog converter circuit 30 as shown by corresponding designations on the circuit diagrams of FIGS. 3 and 4. The power supplies represented by voltage regulators VR2 and VR3 are used in conjunction with the polarity reversing circuit in the DC power supply circuit 22, as represented by (+) or (−) VR2 or VR3.

The power supply circuit 22 also includes a power bridge rectifier 92 which is connected in circuit with parallel 130 VAC secondaries of the power transformer 72 and provides a DC Output to the DC power output circuit 24. The DC power output of bridge rectifier 92 is regulated by controlling the AC power supply to the bridge rectifier through the diqital control circuit 26 and the digital-to-analog circuit 30 in a manner to be described. The DC power output circuit 24 is connected to the magnetic chuck 12 through conductors 96*a* and 96*b*, alternatively termed the magnetic chuck terminals, which are connected to a set of output terminals 98*a,b* of a reversing circuit, indicated generally at 100, which is in the form of a bridge type network and has a set of input terminals 102*a,b* connected, respectively, to the plus and minus terminals of the bridge rectifier 92.

The reversing circuit 100 includes four triacs 104*a*, *b*, *c* and *d* each of which is connected in a leg of the bridge type network reversing circuit. Each triac 104*a*, *b*, *c* and *d* has its gate operatively coupled to the digital control circuit 26 through an associated optical coupler 106*a*, *b*, *c* and *d*, respectively, which has a transistor output and serves as an optically isolated triac driver to enable selective switching of the corresponding triac into conducting and nonconducting states through the application of a relatively low voltage signal to the associated triac gate. The optical couplers 106*a–d* have very high resistance to current flow in a direction toward the digital control circuit 26 so as to isolate and protect the digital control circuit from any power surges or erratic signals in the power output circuit 24. In this manner, all high voltages are confined to the output circuit 24 and the highest potential to which the digital control circuit 26 and display 28 may be subjected, and also switching circuit 20 and converter circuit 30, is the low +5 VDC power supply from supply circuit 22. The triacs 104*a*, *b*, *c* and *d* define bidirectional current control means selectively connected between the output terminals 98*a,b* and the input terminals 102*a,b* of reversing circuit 100 so as to enable selective directional current flow through the magnetic chuck 12 by providing means for alternately switching the polarity of the voltage signals applied to the terminal connectors 96*a,b* of the magnetic chuck. The triacs 104*a,b,c* and *d* also serve to absorb voltage spikes generated by the magnetic chuck whenever the polarity across it is switched.

The magnetic chuck control system 10 is adapted for four principle operating functions: full power, variable power, residual power and release. The full power function enables application of approximately 115 VDC to the magnetic chuck 12. The variable power function enables selection and application of a magnetic holding power less than 100% of full power. The residual power function enables retention of work pieces on the chuck 112 through a residual holding power or magnetism after the main power has been disconnected. This is desirable to allow an operator to remove a work piece from the chuck, gage the work piece, and place it back on the chuck without disturbing other work pieces on the chuck. The release function serves to demagnetize any work piece on the chuck so as to allow it to be readily removed. As will be hereinafter described, control switches for selecting the various operating functions and associated indicator lights for visually indicating which operating function is energized are mounted on the control panel 36 for operator access and observation. The control switches are connected in the digital control circuit 26 in which the full power switch is indicated at 110, the variable power switch is indicated at 112, the residual power switch is indicated at 114 and the release switch is indicated at 116. The switches 110, 112, 114 and 116 are preferably of the sealed membrane type and may be mounted on the panel 36 as shown in FIG. 1. Corresponding function indicator lamps, preferably of the LED type, are shown at 118, 120, 122 and 124.

In accordance with one feature of the magnetic control system 10, the various operating function switches are electrically digitally interlocked so that the operator can only actuate either the "full power" or "variable power" switch after a "residual" or "release" function has been performed. Actuation of the "release" function switch is prevented when the residual function switch is actuated.

The digital control circuit 26 includes an oscillator or digital timer, such as a commercially available No. 556 dual timer, which contains two 555 timers designated at 128*a* and 128*b*. Timer 128*a* constitutes a stable oscillator which has its frequency determined by a resistor 130, a release cycle timing adjustment 132, a resistor 134 and a capacitor 136 which are connected to form an R-C network coupled to the oscillator 128*a* at its pin connections 1, 2 and 6, as illustrated in FIG. 4. The release cycle timing adjustment 132 enables factory or on-site adjustment of the rate at which the polarity of the output voltage signals applied to chuck 12 by power output circuit 24 are reversed during a demagnetizing operation, and also the rate at which the output across the chuck will decay to zero VDC. For example, the time release cycle during demagnetizing might be selected as approximately 5, 10 or 20 seconds.

The timer 128*b* constitutes a monostable oscillator circuit which is triggered at pin 8 by a capacitor 138 charging through a resistor 140 to VCC. This begins when power is first supplied to the primary of transformer 72. At this first instant of time, capacitor 138 appears as a short to ground, causing pin 8 to appear grounded. This causes the output pin 9 to go high. Pin 9 will remain high ("1") until a capacitor 142 charges to two-thirds of VCC through a resistor 144 at which time pin 9 goes to ground. The output at pin 9 of timer 128*b* is directed to pin 14 of a BCD up/down counter 148 which clears the counter. The output at pin 9 of timer 128*b* is also directed through an inverter 150 (pin 6 being "0") to a dual J-K flip flop 152*a,b* (pins 2 and 7, respectively) so as to set the outputs of pins 14 and 10, respectively, at "0". Pin 6 of inverter 150 returns to a "1" state when pin 9 of timer 128*b* goes to ground ("0").

With power applied to the primary of transformer 72, output pin 13 of counter 148 is at a "0" directed through an inverter 154 so that its pin 11 is at "1". Pin 4 of oscillator 128*a* is at "1" and output pin 5 oscillates back and forth from "0" to "1" to "0", etc. Pin 2 of a NAND gate 156 is "0" so its output pin 3 is "1". With pins 9 and 10 of a NAND gate 158 at "1", its output pin 8 is "0". This enables the green "Release " function indicator LED 124 to light. LED indicators 118, 120 and 122 remain off. The "0" signal on pin 8 of NAND gate 158 is also directed to a display driver 160 (pin 5) which blanks out the display 28 so that it shows no numerical or polarity symbols. At this time, the circuit enables either full power or variable power function to be selected and disables residual power and release functions.

As aforementioned, full power can only be ohtained from the residual or release state or condition of the control circuit 10. With reference to the digital control circuit 26 shown in FIG. 4, full DC power to the chuck 12 is obtained by depressing switch 110 which pulls pin 1 of a NAND gate 164 to the "0" output or ground of pin 6 of a NAND gate 166. Simultaneously, pin 6 of a NAND gate 168 goes to "0" and indicator LED 118 turns on indicating "full power " on. Pin 12 of a NAND gate 170 goes to a "0". Pin 8 of NAND gate 176 goes to "0", stopping the oscillator or timer 28*a* with its pin 4 going to "0" and its pin 5 going to "1".

Pin 4 of oscillator 128*a* is connected to a divider in the form of J-K flip flops 178*a,b* (with clear only) such that the clear inputs to pin 2 of flip-flop 178*a* and pin 6 of flip-flop 178*b* go to "0" which resets the divider forcing pin 9 to "0", pin 8 to "1", pin 12 to "0" and pin 13 to "1". These signals from flip-flop 178*a* force pin 3 of a NAND gate 182 and pin 8 of a NAND gate 184 to "0". The signal is fed from pin 8 of NAND gate 184 through a signal time delay circuit which includes a monostable multivibrator 186, an inverter NAND gate 188 and the J-K flip-flop 152*b* where the "0" appears at the output pin 10 after a predetermined delay and is directed to optical coupler 106*a* through a conductor 190. Pin 3 of NAND gate 182 goes directly to the optical coupler 106*c* through conductor 192. Thus, optical couplers 106*a*, 106*c* and the associated triacs 104*a* and 104*c* are turned on.

Turning on switch 110 also causes pin 11 of counter 148 to "0" through an inverter 196 causing the counter to preset to a predetermined numerical value as determined by pins 1, 9, 10, and 15. This number determines the quantity of pulses applied to the chuck during a release or demagnetizing cycle and is encoded on pins 2, 3, 6 and 7 of the counter. This code is fed to pins 1, 2, 6 and 7 of the LED decoder/driver 160 which decodes the code signal and disolays it as a decreasing decimal number on the digital display 28 during a release cycle. At this time a "0" on pin 3 of an inverter 200 is directed to pin 4 of the decoder to blank out the digit loaded into pin 5 of counter 148 so that display 28 only shows a (+) polarity sign. Simultaneously, pin 13 of counter 148 is forced to "1" so that pins 12 and 13 of inverter 154 are "1", and inverted pin 11 is "0". Pin 8 of NAND gate 158 is "1". This turns off the release indicator LED 124. At this time, pin 10 of a NAND gate 202 is "1" and pin 9 is "1" so that its output pin 8 is "0" and is inverted through an inverter 204 to "1" at pin 11. This disables or locks out the variable power switch 112 so that only residual power switch 114 or release switch 116 will function.

The digital display 28 may comprise a seven segment LED display having plus and minus polarity indication. The display 28 is adapted to display as a digital countdown the number of cycles or steps of reverse polarity successively reduced voltage pulses applied to the magnetic chuck 12 during a demagnetizing or release operation and also indicates the polarity of the particular pulse being applied. In the described embodiment, the display 28 will display the number "9" when a demagnetizing cycle is initiated and will countdown until the display reads "0" at which time the voltage potential at the chuck is zero VDC and the demagnetizing or release sequence is completed. The counter 148 is preferably set so that 10 pulses are established over a time period of approximately 7–8 seconds.

The number encoded on output pins 2, 3, 6 and 7 of counter 148 is fed to pins 10, 11, 12 and 13 of a digital-to-analog converter 208 which multiplies the encoded number from the counter by a reference voltage as present at pin 15 of the converter 208. In the described embodiment, the reference voltage is derived from pin 16 of converter 208 which is a (+) 2.5 VDC precision reference voltage connected to a variable DC output adjustment 210. The setting of variable adjustment 210 determines the multiplier at pin 15 of converter 208 and controls the analog output voltage at pin 14 of the converter. The variable adjustment 210 includes an external control knob 210*a* mounted on the panel 36 to enable operator selection of a variable voltage less than 100% of the full power voltage to be applied to the magnet 12 during a variable voltage mode of operation.

In the case of full power selection, a "0" appears on pin 1 of a NAND gate 212 when the full power switch 110 is closed. This makes a "0" appear at pin 6 of a NAND gate 214 and at pin 2 of an optically isolated transistor coupler 218, thus turning this coupler on. The output of pins 4 and 5 of coupler 218 effectively short out pins 15, 16 of converter 208. This is like setting the variable power adjustment 210 to the 100% setting. The 0% setting of adjustment 210 is connected through a diode 220 to pin 3 of NAND gate 212 which is now sitting at a "1" level, effectively removing adjustment 210 from the digital control circuit. The output at pin 14 of converter 208 is maximum at this time and adjusting the variable adjustment 210 has no effect on the DC output which is maximum. During selection of variable power or release functions, optical coupler 218 is off, returning variable power adjustment 210 to its normal function.

The analog output from pin 14 of converter 208 is fed through a conductor 222 to pin 3 of an operational amplifier 224 and amplified to a sufficient level required by a phase control network 226. The control voltage input across pins 8(+) and 6(−) of the phase control 226 determines the phase angle at which a control triac 230 will fire. Zero volts between pins 8 and 6 of phase control 226 will make triac 230 conduct fully. Increasing the voltage at pin 8 with respect to pin 6 of phase control 226 will make triac 230 conduct less. The operational amplifier 224 is thus connected as an inverting amplifier; that is, with a maximum voltaqe input to pin 3, the output at pin 4 is zero and vice versa. An optical coupler 232 controls the state of triac 230. With coupler 232 turned off, triac 230 through phase control 226 is always off. A low voltage adjustment 234 is connected to the phase control network 226 to enable adjustment as necessary to insure zero voltage across the chuck terminals 96*a,b* when the variable output adjustment 210 is set at zero percent of full power.

The optical coupler 232 is controlled by the "0" on pin 9 of flip-flop 178*b* directed through a signal time delay circuit made up of a monostable multivibrator 236, an inverter 238 and a J-K flip-flop 240 the output pin 13 of which is at "0" after a predetermined time delay. The "0" state from pin 13 of flip-flop 240 is directed to pin 5 of a NAND gate 242. Pins 9 and 10 of NAND gate 244 are "1" making pin 8 "0" and pin 2 of optical coupler 232 "0" so as to turn it on.

With the triacs 104*a* and 104*c* having previously been turned on by closing switch 110 as aforedescribed, and with full power being applied to amplifier 224, triac 230 will conduct fully so that the maximum output voltage from bridge rectifier 92 is applied to the magnetic chuck 12 to maintain the ferromagnetic work piece or object 14 in substantially fixed relation on the magnetic chuck irrespective of the setting of the variable DC output adjustment 210.

Variable power operation can only be obtained from the residual or release states. Variable DC power to the magnetic chuck 12 is obtained by depressing switch 112 which pulls pin 13 of a NAND gate 248 to the "0" output or ground of pin 11 of inverter 204. Simultaneously, pin 8 of a NAND gate 250 goes to "0" and indicator LED 120 turns on. The remaining events which take place in the variable DC mode of operation are the same as in the aforedescribed full DC power mode of operation with two exceptions: Firstly, the "0" state on pin 5 of NAND gate 214 causes its output pin 6 to be "1". Thus, optical coupling 218 is off and variable power adjustment 210 is operative. Secondly, when indicator LED 124 is turned off by the "1" level appearing on pin 8 of NAND gate 158, pin 1 of a NAND gate 252 is a "1" and pin 2 is a "1" so that output pin 3 is "0" and is inverted through inverter 166 at pin 6 to "1". This disables the full power switch 110 so that only residual power switch 114 and release switch 116 will function. In this manner, the full power switch 110 is digitally interlocked so as to prevent its closing during a variable power mode of operation.

The residual power mode of operation can only be obtained after a full power or variable power state has been obtained and not during a release mode. Residual power to the chuck 12 is obtained by depressing switch 114 which pulls pin 5 of a NAND gate 256 to the "0" output of pin 13 of NAND qate 174. Simultaneously, pin 6 of NAND gate 256 goes to "1" and is inverted through an inverter 258 so that its pin 8 is "0". This turns on indicator LED 122 and disables release switch 116. At this time either indicator LED 118 or LED 120 (not both) is on. Pin 1 of a NAND qate 260 is at "1", forcing pin 3 to "0". Pin 9 of a NAND gate 244 is "0" and pin 10 is "1" so as to force its output pin 8 to "1" which appears at pin 2 of optical coupler 232 and shuts it off. With coupler 232 off, triac 230 is shut off and the DC output voltage across chuck terminals 96*a* and 96*b* goes abruptly to zero.

With the residual mode now reached, only one function switch, either full power switch 110 or variable power switch 112, will reset the circuit, depending whether indicator 118 LED or LED 120 is on. For example, if LED 118 is on, pin 2 of NAND gate 252 is "0" and pin 1 is "1". Pin 3 is "1" and through inverter 166 pin 6 is "0". This enables full power switch 110. With LED 120 off, pin 9 of NAND gate 202 is "1", pin 10 is "1" and pin 8 is "0" so that pin 11 of inverter 204 is "1". This disables variable power switch 112. The reverse is true if LED 120 is on and LED 118 is off, i.e., switch 112 would be enabled and switch 110 would be disabled.

With full power switch 110 enabled as in the above example, depressing switch 110 puts pin 12 of NAND gate 170 at "0" and pin 13 at "1" so that pin 11 is "1". With pins 9 and 10 of NAND gate 172 at "1", output pin 8 is "0" so that pin 1 of a NAND gate 262 is "0". This resets pin 6 of NAND gate 256 to "0" so that pin 8 of inverter 258 is "1". Indicator LED 122 is thereby turned off. Release switch 116 is enabled and pin 1 of NAND gate 260 is "0" making pin 3 "1". Pins 9 and 10 of NAND gate 244 are "1" and output pin 8 is "0" which is directed to pin 2 of optical coupler 232. This turns coupler 232 on and returns the digital control circuit back to the full or variable power state or mode.

After performing one or more desired operations on the work piece 14, the release or demagnetizing mode of operation of the magnetic chuck control system 10 is initiated by closing release switch 116 such as by pressing the sealed membrane switch 116 mounted on the control panel 26. As aforementioned, the release state can only be obtained after a full power or variable power mode has been obtained, but not after a residual power mode of operation.

Depressing the release switch 116 to initiate a release mode or cycle pulls pin 1 of a NAND gate 266 to the "0" output or ground of pin 6 of NAND gate 256. Simultaneously, a "0" on pin 1 of NAND gate 266, pin 2 being at "1", forces output pin 3 to "1" such that pin 6 of an inverter 268 is "0" and pin 9 of NAND gate 176 is "0". This makes pin 8 of NAND gate 176 go to "1" which is directed to pin 4 of oscillator timer 128*a* and causes it to oscillate. The "0" on pin 1 of NAND gate 266 is fed back to pin 5 of NAND gate 168 and pin 9 of NAND gate 250. Whichever indicator LED (LED 118 or LED 120) is on will be turned off.

Depressing the release switch 116 also causes the decimal number representing the preset value of the encoded number on counter 148 to be digitally displayed on display 28. At this time, pin 4 of timer 128*a*, pin 4 of decoder/driver 160, and pins 11 and 13 of counter 148 are "1". The counter 148 begins to count down oscillator pulses applied at its pin 4 from the output pin 5 of timer 128*a* through NAND gate 156 and J-K flip-flop 178*b*. The pulses from pin 8 of J-K flip-flop 178*b* are also fed through J-K flip-flop 178*a* and two inverters 270 and 272 to NAND gates 182 and 274. The inverters 270 and 272 do not change the state of the pulse applied from input pins 12 and 13 of NAND gate 270 to output pin 8 of NAND gate 272 but cause a predetermined delay which enables the arrival of all signals at NAND gates 182 and 274 to be simultaneous.

Pin 3 of NAND gate 182 and pin 8 of inverter 184 are now at "1", while pin 6 of an inverter 276 and pin 11 of NAND gate 274 are at "0".

The "0" signal from pin 6 of inverter 276 is fed through a signal time delay circuit made up of a monostable multivibrator 278, an inverter 280 and the J-K flip-flop 152*a* where the "0" appears at the output pin 14 after a predetermined delay and is directed to pin 2 of optical coupler 106*b* through a conductor 282. The "0" signal from pin 11 of NAND gate 274 is fed directly to optical coupler 106*d* through a conductor 284. This turns optical couplers 106*b*, 106*d* and corresponding triacs 104*b*, 104*d* on which reverses the polarity of DC output voltage at terminals 96*a* and 96*b* of the chuck 12 and decreases its magnitude by a value defined as the quotient of the original DC voltage applied at the outset of the release cycle divided by the total number of pulses during the release cycle. For example, if 115 VDC is being applied to the chuck 12 when a release cycle is initiated, and the timer 128*a* is set to establish ten pulses during a release cycle, then the output voltage applied by bridge rectifier 92 to the chuck decreases by a value of 11.5 VDC during each polarity reversal during the release cycle. This reversing of polarity and stepped decreasing of applied voltage to the chuck continues until counter 148 reaches a number zero. At this time the DC output voltage at terminals 96*a,b* of the chuck will be zero, and this is indicated by the display 28 visually displaying a "0". A "0" signal from pin 13 of counter 148 is transmitted to pins 12 and 13 of inverter 154 and to pin 2 of NAND gate 156 so that pin 8 of NAND gate 158 goes to "0". This makes indicator LED 124 turn on indicating the release cycle is complete.

During the release cycle the following takes place at the terminals 96*a* and 96*b* of magnetic chuck 12. A DC voltage appears as a "+" polarity at 96*a* and a "−" polarity at 96*b* through triacs 104*a* and 104*c*. The optical coupler 106*a* is turned on with the output pin 10 of J-K flip flop 152*b* at "0", and coupler 106*c* is turned off when the output pin 3 of NAND gate 182 goes to "1". The phase control triac 230 is turned off through the phase control network 226 and pin 2 of optical coupler 232 going to "1" from NAND gate 244. The triacs 104*a* and 104*c* remain in a conducting state or "on" condition from the stored energy in the inductive load of the chuck and work piece which maintains the voltage across triacs 104*a* and 104*c*.

With optical coupler 106*a* on, optical coupler 106*b* is turned on by pin 6 of inverter 276 going to "0" momentarily. The timing sequence is governed by the J-K flip flops 178*a* and 178*b*. The "0" signal from pin 6 of inverter 276 is delayed a preselected amount of time, such as approximately 20 milliseconds, by the delay circuit formed by multivibrator 278, inverter 280 and J-K flip flop 152*a*.

Turning on the optical couplers 106*a* and 106*b* turns on the corresponding triacs 104*a* and 104*b* forming a crow-bar short across the chuck terminals 96*a,b* so as to dissipate the stored energy in the inductive load. As this energy is dissipated, the voltage across the two triacs 104*a* and 104*b* goes to zero at which time triacs 104*a,b* turn off.

Substantially simultaneously with turning off the two triacs 104*a* and 104*b*, triacs 104*b* and 104*d* turn on and triac 230 turns on after a short time delay, such as approximately 300 milliseconds, as established by the time delay circuit of multivibrator 236, inverter 238 and J-K flip flop 240. A DC voltage signal appears at the chuck terminals 96*a,b* which has been decreased a predetermined stepped amount and is of opposite polarity from the immediately preceeding voltage signal applied to the chuck.

The optical coupler 106*b* remains on from the output pin 14 of J-K flip flop 152*a* being at "0". Triac 230 and optical couplers 232 and 106*d* are then turned off. Triacs 104*b* and 104*d* remain on from the stored energy in the load comprising the chuck and work piece. Optical coupler 106*a* is again turned on momentarily in timed sequence governed by the J-K flip flops 178*a* and 178*b*. The "0" signal from inverter 184 is delayed a preselected time period, such as approximately 20 milliseconds, through the time delay circuit of multivibrator 186, inverter 188 and J-K flip flop 152*b*. After a short time, triac 104*a* turns on. Triac 104*b* is on so as to form a crow-bar short across the output terminals 96*a,b* at the chuck 12 to again dissipate the stored energy in the inductive load. This process repeats itself until the counter 148 reaches the number zero at which point the release cycle is complete as indicated by turning on of the LED 124 and the blanked out digital display 28. By being digitally controlled, the successive voltage reductions to the chuck are linear; that is, the voltage reductions are in precise equal steps. The final voltage applied to the chuck is substantially zero.

Figure 5:
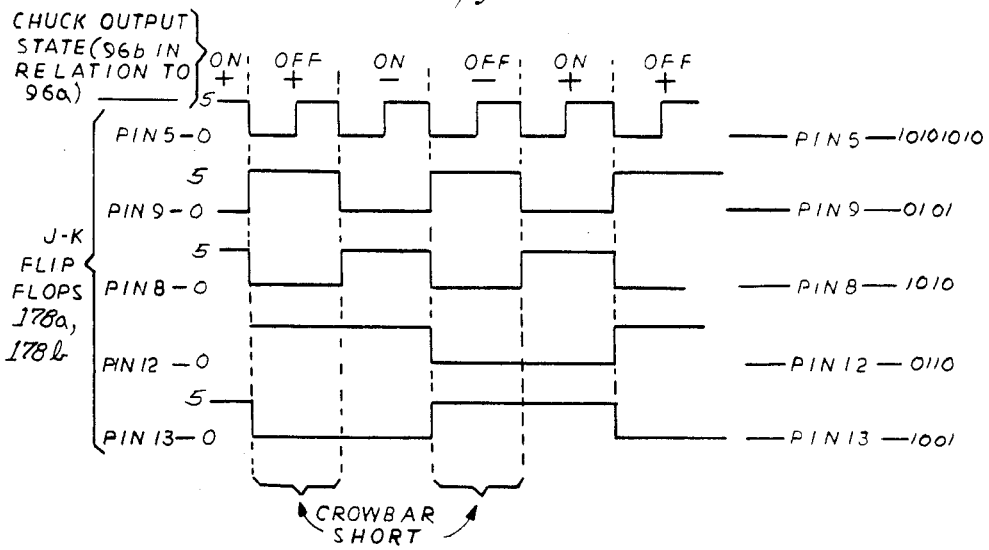
FIG. 5 is a logic diagram illustrating the various logic states of the magnetic chuck in relation to the digital control circuitry.
Figure 6:
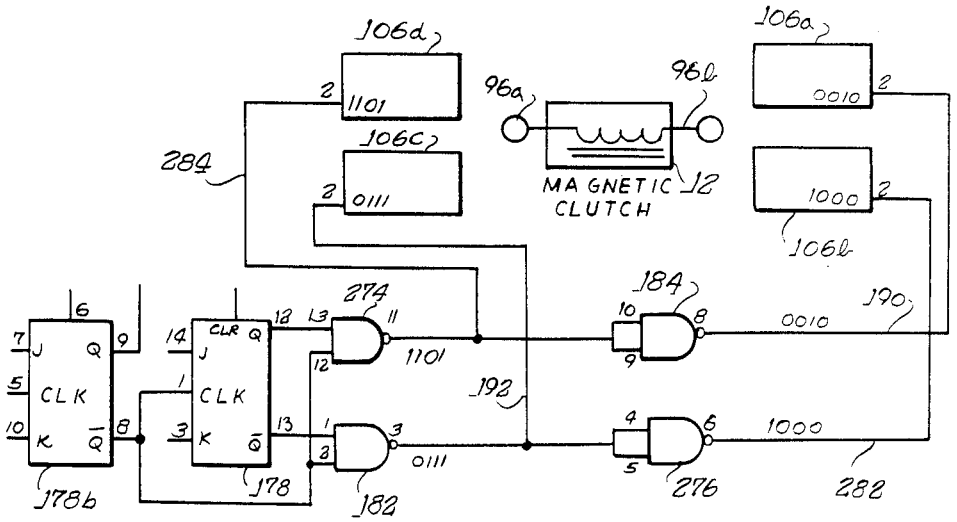
FIG. 6 is a schematic diagram showing the relation of the various logic states of the optical couplers for controlling current flow through the magnetic chuck in relation to the logic states of the associated control circuitry.

FIGS. 5 and 6 illustrate, respectively, a logic diagram and a schematic diagram illustrating the optical couplers 106*a,b,c* and *d* as controlled by the J-K flip flops 178*a* and 178*b*. The logic diagram of FIG. 5 indicates the various logic states, i.e. "0" or "1", of the various pin connections of the J-K flip flops 178*a* and 178*b*, in relation to the corresponding current conduction and polarity states of the magnetic chuck 12. FIG. 6 indicates the logic states, i.e. "0" or "1" , of the NAND gates 182 and 274 and inverters 184 and 276, and the corresponding states of the optical couplers 106*a,b,c* and *d*. A "0" on pins 2 of the optical couplers 106*a,b,c* and *d* turns them on while a "1" signal turns them off.

The various described time delays for signals applied to the optical couplers 106*a*, 106*b* and 232 and thereby to the triacs 104*a*, 104*b* and 230 delay the turn on of these elements but not their turn off. The various signal time delays prevent simultaneous turning on and off of the associated elements.

Thus, in accordance with the present invention, a system for controlling a magnetic chuck is provided which employs a completely digital type control circuit portion which is substantially immune to noise and ambient temperature variations such that drifts and erratic operation are eliminated. By employing a relatively low 5 VDC power supply for all circuits except the power output circuit, and by isolating the power output circuit from the remaining circuits through optical couplers, the highest potential that might be realized at the control panel switches in the event of a fault current in the power output circuit would be a harmless 5 VDC. Further, by employing triacs and associated optical couplers in the reversing circuit 100, the control circuitry is protected from any power surges at the output of the power output circuit 24 at all times, thus assuring elimination of any unexpected or erratic outputs.

In applications where it is desired that the holding or power output voltage of the power output circuit 24 be less than full power, i.e. approximately 115 VDC, the only adjustment required is to decrease the reference voltage through adjustment of variable adjustment knob 210*a*, thus making its product with the value encoded on the counter correspondingly smaller.

While a preferred embodiment of the present invention has been illustrated and described, it will be understood that changes and modifications may be made therein without departing from the invention in its broader aspects. Various features of the invention are defined in the following claims.

What is claimed is:

1. A system for magnetizing and demagnetizing a magnetizable object, comprising, in combination, a DC power supply including a power supply circuit having an AC power supply and a bridge rectifier adapted to establish said DC power supply, a power output circuit operatively connected to said DC power supply and a magnetizable object and adapted to apply DC voltage signals to the object in a manner to magnetize the object, said output circuit including a reversing circuit enabling reversing of the polarity of said DC voltage signals during demagnetizing, said reversing circuit defining a pair of input terminals connected in circuit with said DC power supply and a pair of output terminals connected to the object, bidirectional current control means selectively connected between said pairs of terminals so as to enable selective directional current flow through the object, a digital control circuit operatively associated with said current control means and operative to effect predetermined sequential conditioning of said bidirectional current control means so as to enable current flow through the object in alternating directions, a digital-to-analog converter circuit cooperative with said digital control circuit and adapted to produce successive output voltage signals of predetermined decreasing magnitude in direct relation to said predetermined conditioning of said bidirectional control means, and means connected in circuit with said DC power supply and said reversing circuit and being responsive to said successive output signals to control successively decreasing DC voltage signals to the object, said digital control circuit being adapted to control said bidirectional current control means so that said successively decreasing DC voltage signals applied to the object are of alternating polarity, said means for controlling said successively decreasing DC voltage signals to said object including switch means connected in said power supply circuit between said AC power supply and said bridge rectifier and being controlled by said digital-to-analog converter circuit and said digital control circuit.

2. The system as defined in claim 1 wherein said switch means includes a triac controlled by said digital control circuit.

3. A system for magnetizing and demagnetizing a magnetizable object, comprising, in combination, a DC power supply, a power output circuit operatively connected to said DC power supply and a magnetizable object and adapted to apply DC voltage signals to the object in a manner to magnetize the object, said output circuit including a reversing circuit enabling reversing of the polarity of said DC voltage signals during demagnetizing, said reversing circuit defining a pair of input terminals connected in circuit with said DC power supply and a pair of output terminals connected to the object, bidirectional current control means selectively connected between said pairs of terminals so as to enable selective directional current flow through the object, a digital control circuit operatively associated with said current control means and operative to effect predetermined sequential conditioning of said bidirectional current control means so as to enable current flow through the object in alternating directions, a digital-to-analog converter circuit cooperative with said digital control circuit and adapted to produce successive output voltage signals of predetermined decreasing magnitude in direct relation to said predetermined conditioning of said bidirectional control means, and means connected in circuit with said DC power supply and said reversing circuit and being responsive to said successive output signals to control successively decreasing DC voltage signals to the object, said digital control circuit being adapted to control said bidirectional current control means so that said successively decreasing DC voltage signals applied to the object are of alternating polarity, said system including full power, variable power, residual and release modes of operation, and said digital control circuit including means preventing initiation of a full power mode of operation when the system is in a variable power mode of operation.

4. The system as defined in claim 3 wherein said digital control circuit includes digital control means preventing initiatin of a residual power mode of operation when the system is conditioned in a release mode of operation.

5. The system as defined in claim 3 wherein said digital control circuit includes digital control means preventing initiation of a release mode of operation when the system is conditioned for a residual power mode of operation.

6. A system for magnetizing and demagnetizing a magnetizable object, comprising, in combination, a DC power supply, power output circuit operatively connected to said DC power supply and a magnetizable object and adapted to apply DC voltage signals to the object in a manner to magnetize the object, said output circuit including a reversing circuit enabling reversing of the polarity of said DC voltage signals during demagnetizing, said reversing circuit defining a pair of input terminals connected in circuit with said DC power supply and a pair of output terminals connected to the object, bidirectional current control means selectively connected between said pairs of terminals so as to enable selective directional current flow through the object, a digital control circuit operatively associated with said current control means and operative to effect predetermined sequential conditioning of said bidirectional current control means so as to enable current flow through the object in alternating directions, a digital-to-analog converter circuit cooperative with said digital control circuit and adapted to produce successive output voltage signals of predetermined decreasing magnitude in direct relation to said predetermined conditioning of said bidirectional control means, and means connected in circuit with said DC power supply and said reversing circuit and being responsive to said successive output signals to control successively decreasing DC voltage signals to the object, said digital control circuit being adapted to control said bidirectional current control means so that said successively decreasing DC voltage signals applied to the object are of alternating polarity, said digital control circuit being operative to produce discrete digital control signals of predetermined time duration, and including means responsive to said discrete control signals for selectively conditioning said bidirectional current control means for current flow therethrough, said reversing circuit comprising a bridge type network having bridge legs connected between alternate ones of said input and output terminals, each of said bridge legs having a triac connected in circuit therein, said digital control means being operatively connected to said triacs so as to enable selective current flow therethrough in direct response to said discrete digital control signals, said triacs having their gates operatively connected to said digital control circuit so that said triacs may be selectively controlled by a relatively low supply voltage applied to said digital control circuit, the gate of each of said triacs being interconnected to said digital control circuit through a corresponding transistor controlled opto-coupler.

7. A system for magnetizing and demagnetizing a magnetizable object, comprising, in combination, a DC power supply, a power output circuit operatively connected to said DC power supply and a magnetizable object and adapted to apply DC voltage signals to the object in a manner to magnetize the object, said output circuit including a reversing circuit enabling reversing of the polarity of said DC voltage signals during demagnetizing, said reversing circuit defining a pair of input terminals connected in circuit with said DC power supply and a pair of output terminals connected to the object, bidirectional current control means selectively connected between said pairs of terminals so as to enable selective directional current flow through the object, a digital control circuit operatively associated with said current control means and operative to effect predetermined sequential conditioning of said bidirectional current control means so as to enable current flow through the object in alternating directions, a digital-to-analog converter circuit cooperative with said digital control circuit and adapted to produce successive output voltage signals of predetermined decreasing magnitude in direct relation to said predetermined conditioning of said bidirectional control means, and means connected in circuit with said DC power supply and said reversing circuit and being responsive to said successive output signals to control successively decreasing DC voltage signals to the object, said digital control circuit being adapted to control said bidirectional current control means so that said successively decreasing DC voltage signals applied to the object are of alternating polarity, said digital control circuit being operative to produce discrete digital control signals of predetermined time duration, and including means responsive to said discrete control signals for selectively conditioning said bidirectional current control means for current flow therethrough, and said digital control circuit including time delay circuit means operative to delay application of selected ones of said discrete digital control signals to said bidirectional current controls means.

* * * * *

UNITED STATES PATENT AND TRADEMARK OFFICE

CERTIFICATE OF CORRECTION

PATENT NO. : 4,523,250

DATED : June 11, 1985

INVENTOR(S) : BACCHIERE et al.

It is certified that error appears in the above-identified patent and that said Letters Patent is hereby corrected as shown below:

Col. 3, Line 28, change "±5" to --+5--.

Col. 7, Line 33, change "ohtained" to --obtained--.

Col. 7, Line 43, change "28a" to --128a--.

Col. 8, Line 2, change "disolays" to --displays--.

Col. 9, Line 8, change "voltaqe" to --voltage--.

Col. 9, Line 62, change "qate" to --gate--.

Col. 9, Line 67, change "qate" to --gate--.

Col. 11, Line 37, change ""+"" (with two open quotes) to --"+"-- (with one open and one close quote).

Signed and Sealed this

*Fourth* Day of *February 1986*

[SEAL]

*Attest:*

DONALD J. QUIGG

*Attesting Officer*

*Commissioner of Patents and Trademarks*